US005915577A

United States Patent [19]

Levine

[11] Patent Number: 5,915,577

[45] Date of Patent: Jun. 29, 1999

[54] SEPARATING SEAL SYSTEM FOR CONTAINERS AND METHOD OF MAKING SAME

[75] Inventor: Morton Levine, Champaign, Ill.

[73] Assignee: Selig Sealing Products, Inc., Forrest, Ill.

[21] Appl. No.: 08/841,647

[22] Filed: Apr. 30, 1997

[51] Int. Cl.[6] ..... B65D 39/00

[52] U.S. Cl. ..... 215/232; 215/347; 215/349; 428/344; 428/349; 428/458; 428/481

[58] Field of Search ..... 215/232, 347, 215/349; 428/344, 349, 458, 481

[56] References Cited

U.S. PATENT DOCUMENTS

| | | | |
|---|---|---|---|
| 2,646,183 | 7/1953 | Pellett | 215/347 |
| 2,715,474 | 8/1955 | Phillips | 215/347 |
| 2,937,481 | 5/1960 | Palmer | 215/347 |
| 4,013,188 | 3/1977 | Ray | 215/347 |
| 4,684,554 | 8/1987 | Ou-Yang | 215/232 X |
| 4,778,698 | 10/1988 | Ou-Yang | 215/347 X |
| 4,930,646 | 6/1990 | Emslander | 215/232 |
| 5,197,618 | 3/1993 | Goth | 215/232 |
| 5,381,913 | 1/1995 | Peeters | 215/232 |
| 5,560,989 | 10/1996 | Han | 428/349 |
| 5,702,015 | 12/1997 | Giles et al. | 215/232 |

*Primary Examiner*—Stephen K. Cronin
*Attorney, Agent, or Firm*—Hill & Simpson

[57] ABSTRACT

A seal system is provided for a container that includes a cap. The system provides a seal between the inside surface of the cap and the rim of the container as well as an exposed foil seal on the rim of the container. Removal of the cap from the container results in a cleavage of the seal system between the foil layer that is heat sealed to the rim and the backing structure leaving an exposed upper foil surface and the backing structure which remains attached to the inside surface of the cap. After the foil seal is removed by the consumer, the backing structure disposed on the inside surface of the cap provides a gasket-type seal between the cap and the rim of the container.

23 Claims, 1 Drawing Sheet

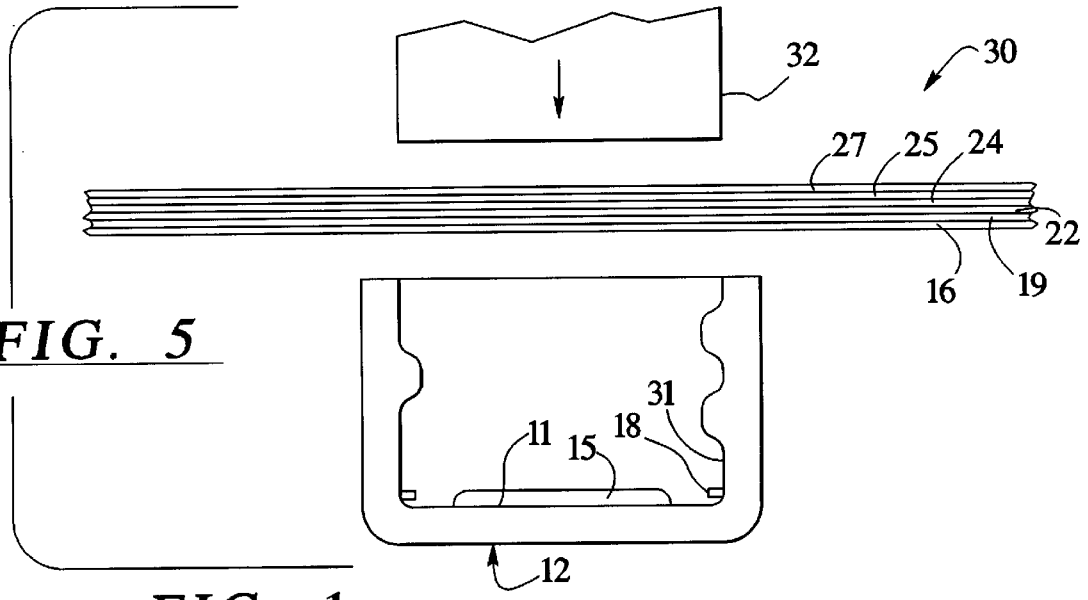
FIG. 5
FIG. 1
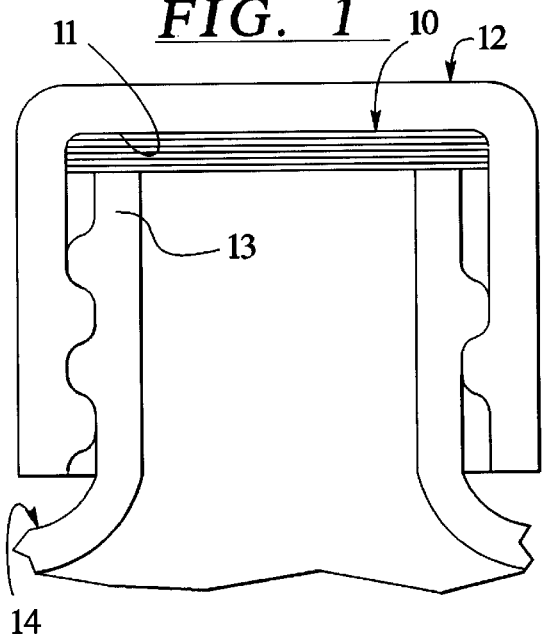
FIG. 3
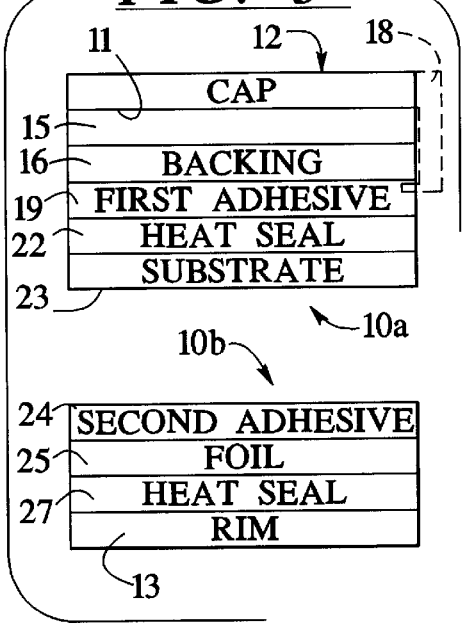
FIG. 2
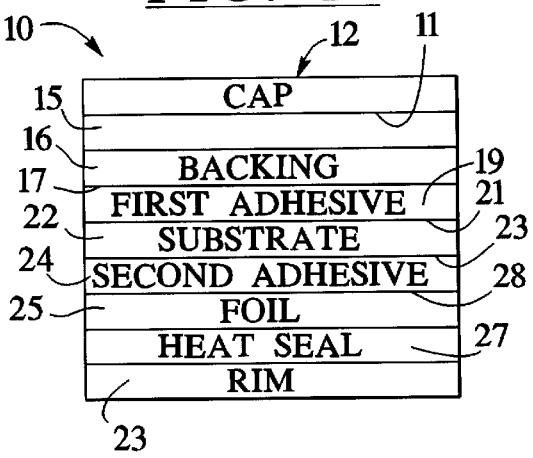
FIG. 4
(PRIOR ART)
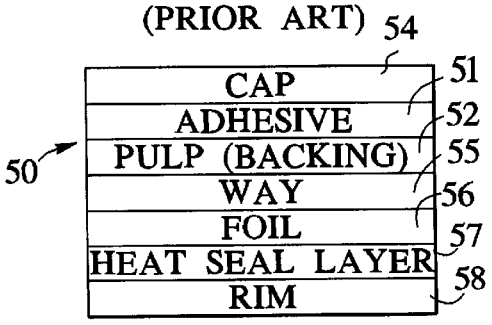

SEPARATING SEAL SYSTEM FOR CONTAINERS AND METHOD OF MAKING SAME

BACKGROUND OF THE INVENTION

The present invention relates generally to seals for containers such as bottles and the like. More specifically, the present invention relates to seals for containers having caps.

In the packaging of certain products, such as bottled products or products provided in jars and other small containers, it is desirable to provide a seal that retains the freshness of the contents and further which indicates whether the seal has been tampered with.

One suitable seal system that indicates whether the seal has been tampered with and further that retains the freshness of the contents disposed within the container is an induction foil lining system. Such induction foil lining systems have been used in the container closure industry for at least 20 years. Currently available foil lining systems include an adhesive layer that attaches a pulp or backing layer to the inside surface of the cap. The backing layer is attached to a foil layer by a coating of wax disposed between the backing and the foil layer. The foil layer is attached to the rim of the container with a heat seal layer.

During assembly, the backing layer of the backing layer/wax layer/foil layer/heat seal layer structure is attached to the inside surface of the cap with the adhesive, often a hot melt adhesive. The cap is then screwed onto the rim of the container so that the heat seal layer that coats the foil layer engages the rim of the container. The assembled container is then passed under an induction heating apparatus which heats the foil layer, resulting in a melting of the heat seal layer and the bonding of the foil layer to the rim of the container. The wax melts and is absorbed into the backing.

When the consumer unscrews the cap from the container, cleavage occurs at the wax layer whereby the backing layer remains attached to the inside surface of the cap and the foil layer layer remains attached to the rim of the container. After the consumer removes the foil layer to obtain access to the product, the backing layer provides a gasket seal between the inside surface of the cap and the rim when the consumer screws the cap back onto the container.

As noted above, currently available foil sealing systems rely upon the incorporation of wax into the sealing structure between the backing layer and the foil seal. Wax is used because it can be readily absorbed into the porous backing layer which reliably allows the backing layer to separate from the foil layer when the consumer unscrews the cap. The use of glue or adhesive instead of wax would make it difficult to remove or separate the cap and the backing layer from the foil seal.

The use of wax, however, is problematic because at least some wax will inevitably remain on the lower surface of the backing layer where it has the opportunity to contaminate the product disposed within the container. Further, container manufacturers are often confronted with the problem of a lack of availability of suitable wax for uses in such sealing systems. Still further, the wax coated backing layer often provides an unreliable gasket seal between the cap and the rim of the container because the wax coating often does not always provide an effective barrier to fluids over the backing layer. A fluid barrier is needed because the backing layer is typically made from a pulp material, which is absorbent.

Accordingly, there is yet to be an effective foil seal system which provides combination of an effective gasket seal between a container lid or cap and the rim of a container which also incorporates a heat or foil seal over the rim of the container and which also does not rely upon the use of wax to removably attach the foil layer to the backing.

Still further, drug manufacturers and food manufacturers have a strong preference for providing a foil seal on the lip or rim of the container which provides an exposed foil surface to the consumer after the consumer removes the cap or lid. Accordingly, it would be beneficial to provide an improved wax-free foil seal system which provides an improved gasket seal between the inside surface of the cap and the rim of the container after the foil seal has been removed, which further provides a foil seal over the rim of the container which includes an exposed upper surface of foil upon removal of the cap or lid from the container.

Accordingly, a need exists for an improved foil sealing system which provides both an improved gasket seal between the container lid or cap and the rim of the container as well as an exposed foil seal over the rim of the container and which does not rely upon the use of wax for connecting the backing layer to the foil layer.

SUMMARY OF THE INVENTION

The present invention provides a solution to the aforenoted needs in the form of an improved sealing system which includes a seal between a cap and a container rim as well as a foil seal on the container rim, a container incorporating the sealing system of the present invention and a method of manufacturing a container incorporating the sealing system of the present invention.

A sealing system made in accordance with the present invention includes a backing layer that is retained against an inside surface of the cap. The backing layer includes a lower surface which is attached to a substrate layer by a first adhesive. The substrate layer also includes a lower surface which is attached to a foil layer by a second adhesive. The foil layer is thereafter attached to the rim of the container, preferably by a heat seal layer.

To manufacture a container incorporating the sealing system of the present invention, the sealing system is provided in a sheet form which includes the backing layer, the first adhesive layer, the substrate layer, the second adhesive layer, the foil layer and the heat seal layer. The sheet is then presented in an upside-down fashion so that the upper surface of the backing layer is facing downward over an inverted cap. The cap is inverted so that the inside surface of the cap is facing upward. A downwardly extending die then punches through the sheet material to cut a portion of the sheet sized to mateably engage the inside of the cap. The die pushes the cut portion of the sheet downward so that the backing layer is retained against the inside surface of the cap and so that the heat seal layer is facing upward. The cap is then screwed onto a container so that the heat seal layer is resting on top of the rim of the container between the rim and the foil layer. The assembled container is then passed under an induction heating apparatus which heats the foil layer thereby causing the foil layer to be fastened to the rim of the container by the softened or at least partially liquefied heat seal layer.

The backing layer may be retained against the inside surface of the cap with an adhesive or glue or by a physical retaining means such as a flange or retaining brackets disposed on or adjacent to the inside surface of the cap. Preferably, the backing layer is retained against the inside surface of the cap so that it does not rotate upon rotation of the cap.

Upon removal of the cap from the container, cleavage occurs at the second adhesive layer, or between the lower surface of the substrate and the upper surface of the foil layer. Cleavage at this point may be provided in at least three primary ways. First, the lower surface of the substrate may be coated or treated with a release enhancing material, such as silicone, TEFLON® or a similar release enhancing or lubricating material. When the lower surface of the substrate is coated with a release enhancing material, the bond between the lower surface of the substrate and the upper surface of the foil layer will be weaker than the bond between the lower surface of the backing layer and the upper surface of the substrate.

Second, cleavage between the lower surface of the substrate layer and the upper surface of the foil layer can be assured by using a second adhesive that is weaker than the first adhesive. In other words, using a second adhesive that is weaker than the first adhesive, the sealing system will separate at the second adhesive layer as opposed to the first adhesive layer.

In an exemplary embodiment, the lower surface of the substrate layer is coated with silicone.

In an exemplary embodiment, the lower surface of the substrate layer is coated with TEFLON®.

In an exemplary embodiment, the substrate layer is an extruded film, the lower surface of which is coated with silicone.

In an exemplary embodiment, the lower surface of the substrate is treated with a chemical to enhance its releasability from the second adhesive layer and therefore the upper surface of the foil layer.

In an exemplary embodiment, the backing layer is fabricated from pulp.

In an exemplary embodiment, the backing layer is fabricated from a foam material such as a thermoplastic foam, a thermosetting foam or a polymer foam.

In a preferred embodiment, the substrate layer provides a protective barrier for the backing layer so as to reduce the ability of the backing layer to absorb fluid and so as to further reduce the ability of fluid to migrate through the backing layer from the inside of the container or from the outside of the container.

It is, therefore, an advantage of the present invention to provide an improved sealing system for a container having a cap which provides an exposed foil seal over the rim of the container and which further provides an improved gasket-type sealing mechanism disposed on the inside surface of the cap.

A further advantage of the present invention is that the portion of the seal structure that is retained in the cap is less susceptible to the absorption of liquids.

Another advantage of the present invention is that the sealing mechanism disposed on the inside surface of the cap provides an improved gasket-type seal after the container has been opened.

Another advantage of the present invention is that the sealing mechanism does not incorporate any wax.

Additional features and advantages of the present invention are described in, and will be apparent from, the detailed description of the presently preferred embodiments and from the drawings.

BRIEF DESCRIPTION OF THE DRAWINGS

For a more complete understanding of the present invention, reference should now be made to the embodiments illustrated in greater detail in the accompanying drawings and described below by way of an example of the present invention.

In the drawings:

FIG. 1 is a cross-sectional view of a container top including a sealing system formed in accordance with the principles of the present invention;

FIG. 2 is a schematic illustration of a sealing system formed in accordance with the present invention as disposed between a cap and a rim of a container;

FIG. 3 is a schematic illustration of a sealing system formed in accordance with the present invention after the cap has been removed from the rim of the container;

FIG. 4 is a schematic illustration of a prior art sealing system; and

FIG. 5 is a schematic illustration of a method of installing the sealing system of the present invention into a container cap.

It should be understood that the drawings are not to scale and that the embodiments have been illustrated by diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Turning first to FIG. 1, a sealing system 10 formed in accordance with the present invention is disposed between an inside surface 11 of a cap 12 and the rim 13 of a container 14. In the embodiment illustrated in FIG. 1, the cap 12 is threadably connected to the container 14. However, the present invention is also applicable to caps and closure systems that are snapped in place or otherwise that frictionally engage the opening of a container.

FIG. 2 illustrates the layers of the sealing system of one embodiment of the present invention. Specifically, a backing adhesive 15 is disposed between the cap 12 and a backing layer 16. The backing adhesive 15 effectively attaches the backing layer 16 to the inside surface 11 of the cap 12. As discussed above, the backing 16 may be retained against the inside surface 11 of the cap 12 by other means such as a flange mechanism 18 (see FIG. 3) or other physical retaining means.

The lower side 17 of the backing layer 16 is coated with a first adhesive 19. The first adhesive 19 attaches the backing layer 16 to the substrate layer 22. The substrate layer 22 includes a lower side 23 that is attached to the foil layer 25 by a second adhesive layer 24. The foil layer 25 which, in turn, is connected to the rim 13 of the jar or container 14 with a heat seal or adhesive layer 27.

Upon removal of the cap 12, from the container 14, cleavage occurs between the lower side 23 of the substrate layer 22 and the second adhesive layer 24 as illustrated in FIG. 3. As a result, a foil seal in the form of the foil layer 25 and heat seal layer 27 and exposed upper foil surface 28 remains intact on the rim 13 of the container 14. Further, the second adhesive 24 remains disposed on the upper surface 28 of the foil layer 25. As a result, the second adhesive 24 is discarded by the consumer when he/she removes the foil layer 25 and the second adhesive 24 will not contaminate the product.

Further, a seal mechanism comprising the backing layer 16, first adhesive layer 19 and substrate layer 22 remains on the inside surface 11 of the cap 12. This mechanism provides a gasket-type barrier between the rim 13 of the container 14 and the cap 12 after the foil seal (i.e. the foil layer 25, heat seal layer 27 and second adhesive layer 24) has been removed from the rim 13 by the consumer. The substrate layer 22 provides a fluid barrier between the backing layer 16 and the contents of the container and between the backing layer 16 and the atmosphere.

The seal system 10 of the present invention provides numerous advantages over the system 50 provided by the prior art and shown in FIG. 4. Specifically, the prior art system 50 includes a backing adhesive layer 51 which connects a layer of pulp 52 to the inside surface 53 of the cap 54. A layer of wax 55 is disposed on the underside of the pulp layer 52 which effectively connects the foil layer 56 to the pulp layer 52. A heat seal layer 57 attaches the foil layer 56 to the container rim 58. Upon cleavage, a portion of the wax remains on the pulp layer and a portion of the wax remains on the foil layer 56. As a result, after the foil layer and heat seal layer have been removed (i.e. after the product has been opened and partially used), the portion of the wax 55 disposed on the pulp layer 52 will engage the container rim 58 and has the opportunity to contaminate the contents of the container. Further, the wax 55 does not provide a reliable fluid barrier for the pulp layer 52. As a result, even if the pulp layer 52 is coated with wax, the pulp layer 52 can absorb moisture from the atmosphere, which can contaminate the product, or the pulp layer 52 can absorb the product if it is a liquid. In short, a wax coated pulp layer 52 is not as effective as a sealing gasket as the structure shown at 16-19-22 in FIG. 3. Still further, replacement of the wax 55 with an adhesive would result in a container that is very difficult to open.

Turning to FIG. 5, the system 10 is fabricated as follows. First, a sealing system in the form of a backing layer 16, first adhesive layer 19, substrate layer 22, second adhesive layer 24, foil layer 25 and heat seal layer 27 is provided in a sheet form 30 as shown in FIG. 5. The backing layer 16 is disposed downward, facing the inside surface 11 of the cap 12. In the embodiment shown in FIG. 5, a layer of adhesive 15 is disposed along the inside surface 11 of the cap 12. However, the backing adhesive 15 need not be utilized to attach the backing layer 16 to the inside surface 11 of the cap 12. Instead, a retainer flange 18 may be disposed along the inside surface 31 of the cap 12 to hold the sheet 30 in place.

After the sheet 30 has been moved over the cap 12, a downwardly extending die tool shown at 32 punches a portion out of the sheet 30 and presses the cut portion downward into the cap 12. The die 32 is sized so at to cut a portion that will be mateably received within the cap 12. Of course, other methods of installing a seal 10 into a cap 12 will be apparent to those skilled in the art, including the use of an upwardly extending die or providing perforated portions of the sheet 30 that may be simply punched into the cap 12 or inserted manually or by an alternative mechanical system.

One suitable adhesive for use as the first adhesive layer 19 is sold under the trademark ADCOTE® 76X124 by Morton International, Inc. One suitable adhesive for use as the second adhesive layer 24 is sold under the trademark PROXMELT® 4144X8 by Pierce & Stevens. Other suitable adhesives will be known to those skilled in the art. Further, suitable substrate layers including suitable silicone coated films, TEFLON® films and TEFLON® coated films will be known to those skilled in the art. The backing material may be fabricated from conventional pulp materials or any one of a variety of polymer, thermoplastic or thermosetting foam materials including polypropylene foams, polyethylene foams, polyolefin foams, etc. Suitable adhesives or heat seal materials for use in attaching the backing 16 to the cap 12 are known and will be apparent to those skilled in the art. Finally, other suitable materials for use as a heat seal layer 27 to attach the foil layer 25 to the rim are known to those skilled in the art.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A system for providing a first gasket-type seal between an inside surface of a cap and a rim of a container and for providing a second removable seal on the rim of the container, the system comprising:

a backing layer retained against the inside surface of the cap, the backing layer being attached to an upper surface of a substrate layer by a first adhesive, the substrate layer further comprising a lower surface which is attached to an upper surface of a foil layer by a second adhesive, the foil layer further comprising a lower surface which is attached to the rim of the container by a heat seal layer, whereby removal of the cap from the rim results in disengagement of the substrate layer from the second adhesive layer.

2. The system of claim 1 wherein the lower surface of the substrate layer is coated with a release coating.

3. The system of claim 1 wherein the substrate layer comprises an extruded film, the lower surface thereof being coated with a release coating.

4. The system of claim 1 wherein the lower surface of the substrate layer is coated with silicone.

5. The system of claim 1 wherein the substrate layer comprises TEFLON®.

6. The system of claim 1 wherein the lower surface of the substrate layer is coated with TEFLON®.

7. The system of claim 1 wherein the first adhesive and the second adhesive are the fabricated from a like adhesive material.

8. The system of claim 1 wherein the bond provided by the first adhesive between the backing layer and the substrate layer is stronger than the bond provided by the second adhesive between the lower surface of the substrate layer and the foil layer.

9. The system of claim 1 further comprising a backing adhesive for attaching the backing layer to the inside surface of the cap.

10. The system of claim 1 wherein the backing layer, first adhesive and substrate layer to serve as the first gasket-type seal between the rim of the container and the inside surface of the cap upon removal of the foil layer from the rim of the container, and wherein the foil layer and heat seal layer serve as the second removable seal.

11. A system for providing a first gasket-type seal between an inside surface of a cap and a rim of a container and for providing a second seal on the rim of the container, the system comprising:

a backing layer retained against the inside surface of the cap, the backing layer being attached to an upper surface of a substrate layer by a first adhesive, the substrate layer further comprising a lower surface that is coated with a release material and which is attached to an upper surface of a foil layer by a second adhesive, the foil layer further comprising a lower surface which is attached to the rim of the container by a heat seal layer, whereby removal of the cap from the rim results in disengagement of the substrate layer from the second adhesive layer leaving the backing layer, first adhesive and substrate layer to serve as the first gasket-type seal between the rim of the container and the inside surface of the cap upon removal of the foil layer from the rim of the container, and whereby the foil layer and heat seal layer serve as the second removable seal.

12. The system of claim 11 wherein the release material is silicone.

13. A container comprising:

a cap that mateably receives a rim with a seal system disposed between the cap and the rim, the seal system comprising a backing layer retained against the inside surface of the cap, the backing layer being attached to an upper surface of a substrate layer by a first adhesive, the substrate layer further comprising a lower surface which is attached to an upper surface of a foil layer by a second adhesive, the foil layer further comprising a lower surface which is attached to the rim of the container by a heat seal layer, whereby removal of the cap from the rim results in disengagement of the substrate layer from the second adhesive layer leaving the backing layer, first adhesive and substrate.

14. The container of claim 13 wherein the first adhesive and substrate layer to serve as a gasket-type seal between the rim of the container and the inside surface of the cap upon removal of the foil layer from the rim of the container, and whereby the second adhesive, foil layer and heat seal layer serve as a removable seal.

15. The container of claim 13 wherein the lower surface of the substrate layer is coated with a release coating.

16. The container of claim 13 wherein the substrate layer layer comprises an extruded film, the lower side thereof comprising a release coating.

17. The container of claim 13 wherein the lower surface of the substrate layer is coated with silicone.

18. The container of claim 13 wherein the bond provided by the first adhesive between the backing layer and the substrate layer is stronger than the bond provided by the second adhesive between the lower surface of the substrate layer and the foil.

19. A method of providing a first gasket-type seal between a cap and a rim of a container and for providing a second removable seal over the rim of the container and for attaching a portion of a seal structure to an inside surface of the cap, the method comprising the following steps:

providing a seal system in the form of a sheet comprising a backing layer comprising an upper surface for engaging the inside surface of the cap and a lower surface which is attached to an upper surface of a substrate layer by a first adhesive, the substrate layer further comprising a lower surface which is attached to an upper surface of a foil layer by a second adhesive, the foil layer further comprising a lower surface which is coated with a heat seal layer, providing a means for retaining the backing layer against the inside surface of the cap, providing the cap in an inverted position so that the inside surface of the cap faces upwards, placing the sheet upside-down over the inverted cap so that the upper surface of the backing layer faces downward towards the inside surface of the cap and the heat seal layer is disposed upwards, cutting the sheet with a downwardly extending die to provide a cut portion of the sheet that mateably engages the cap, pushing the cut portion of the sheet into the cap so that the upper surface of the backing layer engages the inside surface of the cap, placing the cap over the rim of the container so that the heat seal layer disposed on the lower surface of the foil layer engages the rim, heating the foil layer.

20. The method of claim 19 wherein the foil layer is heated using an induction heating apparatus.

21. The method of claim 19 wherein the means for retaining the backing layer against the inside surface of the cap comprises providing a third adhesive on the inside surface of the cap.

22. The method of claim 19 wherein the lower surface of the substrate layer is coated with silicone.

23. The method of claim 19 wherein the means for retaining the backing layer against the inside surface of the cap comprises providing a retainer flange disposed along an inside wall surface of the cap that retains the backing layer against the inside surface of the cap.

* * * * *